US008851397B1

(12) United States Patent
van der Steur et al.

(10) Patent No.: US 8,851,397 B1
(45) Date of Patent: Oct. 7, 2014

(54) BELL CUP ATOMIZER HAVING IMPROVED CLEANING CAPABILITY

(71) Applicants: Gunnar van der Steur, Chesapeake City, MD (US); Joseph Cichocki, Newark, DE (US)

(72) Inventors: Gunnar van der Steur, Chesapeake City, MD (US); Joseph Cichocki, Newark, DE (US)

(73) Assignee: EFC Systems, Inc., Havre de Grace, MD (US)

( * ) Notice: Subject to any disclaimer, the term of this patent is extended or adjusted under 35 U.S.C. 154(b) by 0 days.

(21) Appl. No.: 14/079,797

(22) Filed: Nov. 14, 2013

(51) Int. Cl.
*B05B 15/02* (2006.01)
*B05B 3/10* (2006.01)
*B05B 3/02* (2006.01)

(52) U.S. Cl.
CPC ..... *B05B 15/025* (2013.01); *Y10S 901/43* (2013.01)
USPC ..... 239/112; 239/106; 239/222.11; 239/223; 901/43

(58) Field of Classification Search
USPC ..... 239/104, 106, 110, 112, 222.11, 223, 239/224, 700, 701, 703; 901/43
See application file for complete search history.

(56) References Cited

U.S. PATENT DOCUMENTS

| | | | | |
|---|---|---|---|---|
| 5,106,025 | A | 4/1992 | Giroux et al. | |
| 5,707,009 | A | 1/1998 | Schneider | |
| 5,813,608 | A | 9/1998 | Yoshioka et al. | |
| 5,862,988 | A | 1/1999 | Van der Steur | |
| 5,894,993 | A * | 4/1999 | Takayama et al. | 239/112 |
| 5,909,849 | A | 6/1999 | Yamasaki et al. | |
| 6,003,785 | A * | 12/1999 | Duey | 239/223 |
| 6,050,499 | A | 4/2000 | Takayama et al. | |
| 6,189,804 | B1 * | 2/2001 | Vetter et al. | 239/7 |
| 6,341,734 | B1 * | 1/2002 | Van Der Steur | 239/223 |
| 6,360,962 | B2 | 3/2002 | Vetter et al. | |
| 6,578,779 | B2 | 6/2003 | Dion | |
| 6,659,367 | B2 | 12/2003 | Ballu | |
| 2002/0170580 | A1 * | 11/2002 | Clifford et al. | 134/36 |
| 2003/0164406 | A1 * | 9/2003 | Ballu | 239/224 |
| 2005/0040257 | A1 | 2/2005 | Seitz | |
| 2012/0137968 | A1 | 6/2012 | Nolte et al. | |
| 2012/0193453 | A1 * | 8/2012 | Nakazono et al. | 239/461 |

* cited by examiner

*Primary Examiner* — Darren W Gorman
(74) *Attorney, Agent, or Firm* — E. Alan Uebler, P.A.

(57) ABSTRACT

Rotary bell cup atomizing apparatus is provided having a rotatable bell cup driven by a motor shaft dimensioned so as to provide an annular gap between the outer, rear surface of the cup and the shaft extending an effective distance axially adjacent the shaft. Solvent channels extend within the assembly circumventing the gap and discharge into the gap. During cleaning of the atomizer, solvent passes partially through the paint nozzle and partially through the solvent channels impinging directly upon the shaft, then migrating over the outer surface of the cup. The inner and outer surfaces of the bell cup and the motor shaft are simultaneously cleaned. A replaceable sleeve placed inside the cup adjacent the front surface thereof absorbs the force of paint impinging thereon. The cup may have at least one balancing indentation immediately adjacent the sleeve.

15 Claims, 4 Drawing Sheets

BELL CUP ATOMIZER HAVING IMPROVED CLEANING CAPABILITY

FIELD OF THE INVENTION

The invention relates to rotary bell cup atomizers and, more specifically, to such atomizers having improved atomizing capability, longer cycle life, and improved anti-fouling features.

BACKGROUND OF THE INVENTION

Rotary bell cup atomizers are used to apply paint to workpieces, more particularly, they are used to paint automobile and other vehicle bodies. Known rotary atomizers include a rotating bell cup having a generally conical inner front flow surface extending between an inner, axially central opening and a radially outer atomizing edge. Conventional bell cup atomizers further include a deflector which is generally rotationally symmetric about a central axis and is positioned in front of the central opening such that paint entering the bell cup through the central opening impacts the rear surface of the deflector and is disbursed radially outwardly towards the front diverging flow surface of the cup, flowing thereover to the outer edge of the cup where it is atomized to a fine mist.

The paint so applied is known to follow a tortuous and turbulent path, from the nozzle at the cup center to the outer atomizing edge. Atomization is effected by centrifugal forces produced when the cup, mounted on a central motor shaft, is rotated at high speeds, typically at 60-70,000 RPM.

Bell cups can have different shapes and configurations. Air can be supplied around the outer periphery of the cup to form a shroud that is concentrically positioned over the bell cup, adjacent to where atomized coating material leaves the bell cup, to direct the atomized coating material in a controlled pattern toward the workpiece to be coated.

The bell shaped body can have a generally conical cavity defining an inner diverging flow surface at the front or distal end of the bell shaped body, the inner flow surface extending from an inner coating material source to a radially outer spray edge. In operation, the bell cup is rotated around a stationary nozzle, the nozzle having passageways or channels housed therein through which materials such as paint and cleaning solvent are supplied.

One known problem with bell cup atomizers is that coating material can accumulate on the outer exposed surfaces of the bell cup in use. During a subsequent use, the accumulated coating material can dislodge from the bell cup, be propelled into the paint stream, and undesirably mix with new coating material, especially after a paint change, and cause visible imperfections in the painted workpiece. These imperfections are called "dirt" in the industry parlance. Therefore, it is highly desirable to efficiently clean all outer surfaces of such unwanted material.

One solution is to separately feed solvent or jet air to the outer peripheral surfaces to remove or prevent the unwanted material from adhering thereto. See, for example U.S. Pat. Nos. 5,862,988, 5,707,009 and 5,106,025. Another solution, as disclosed for example in U.S. Pat. No. 5,707,009, uses a stationary nozzle having a plurality of channels that are separate from the coating material channel for delivering solvent to the inner flow surface and the outer surface of the bell cup. Since the solvent channels are independent from the coating material channel, the bell cup can be rinsed with solvent (rinsing or cleaning agent) without having to remove the paint from the paint channel. The feed nozzle, which is coaxially arranged with the bell cup, delivers either solvent or coating material on command from sources located upstream of the rear or proximal end of the bell cup.

In U.S. Pat. No. 5,707,009, the bell cup has an annular cavity located within the rear section of the bell cup, communicating with the solvent channels. The annular cavity creates a large annular space through which solvent flows and moves around the rearward edge onto the outer surface of the bell element ('009, col. 2, lines 3-20). During use, while the bell cup undergoes a painting operation, this annular cavity is prone to paint accumulation, forming undesirable "dirt" on a workpiece in subsequent applications. Improved cleaning of the outer periphery of the bell cup paint applicators is needed. The present invention addresses this need.

A more recent attempt to solve the "dirt" problem is disclosed in U.S. Pat. No. 6,050,499. Therein, a rotary cup atomizer is provided with solvent passages in the cup which communicate a paint reservoir with the outer peripheral surface of the bell cup. Solvent which flows out onto the outer peripheral surface of the bell cup through the passages is guided toward the marginal releasing edge of the bell cup. Assist air is spurted out through assist air outlet holes which are provided in the fore end face of a shaping air ring at positions radially on the inner side of shaping air outlet holes. At the time of a washing operation, the solvent which flows out onto the outer peripheral surface of the bell cup is forcibly pushed to the outer peripheral surface by the action of assist air and shaping air as the solvent is guided toward the fore end of the bell cup to wash away deposited paint therefrom.

In a typical coating operation, different flow configurations of coating materials can be required, thereby requiring changed flow-directing components. For some known bell cups, the entire bell cup atomizer must be detached from the supply manifold, and an entire new assembly must be attached, and this procedure must be repeated each time the coating operation requires a change in the flow configuration of the coating material, thereby resulting in the interruption of the paint cycle and unwanted downtime. Paint continuously discharging radially outwardly from the aforesaid deflector directly impacts the forward, radially inward diverging conical surface of the bell cup. This continuous impaction of coating material onto the inner flow surface of the cup can cause premature wear of this surface, thereby resulting in premature, but required, cup replacement, accompanied by its concomitant downtime, and an undesirable interruption in a production cycle. The invention disclosed herein alleviates this problem significantly and, in combination with one of its embodiments, presents an entirely new structural advance which provides precise rotational balancing of the high speed rotating cup about its axis, all thereby extending the life of the cup in its production cycles.

SUMMARY OF THE INVENTION

Rotary bell cup atomizing apparatus having an improved, integral cleaning capability is provided. The apparatus includes a rotary bell cup atomizer having a rotatable bell cup component mounted at its proximal end to a rotatable motor shaft, the cup having a conically diverging opening distally of the motor shaft and being connected thereto by means of a hollow hub affixed to or integral with the cup, the cup and hub being mated thereat. The motor shaft is hollow and houses supply lines for different fluids. The supply lines are connected at their upstream ends to respective fluid supply reservoirs, with each line extending into the hub to supply a desired fluid thereto on demand. The supply lines include at least one paint supply line for supplying paint to the inner front conically diverging surface of the cup via a conventional nozzle wherein, in operation, the paint is atomized and applied to a substrate workpiece. At least one solvent cleaning agent supply line is also provided, as is a supply of shaping air. The mated cup and hub receive the motor shaft at its distal end, with the hub, shaft and cup being dimensioned so as to provide an annular gap between the outer, rear surface of the cup and adjacent to the motor shaft. This annular gap extends an effective and substantial distance axially adjacent the shaft. The mated cup and hub include a plurality of solvent channels formed therein which extend from entrance openings from the hollow of the hub and extend within the body of the hub so as to circumvent the annular gap. Each of these channels then extends within the cup and hub in a direction generally rearwardly to an intermediate opening into a manifold channel which extends circumferentially about the axis of rotation of the cup, thereby interconnecting all of the solvent channels via this circumferential manifold channel. The mated cup and hub also includes a plurality of solvent discharge channels which extend generally rearwardly from the circumferential manifold channel, with each discharge channel extending to an exit opening therefrom proximate the distal end of the annular gap. During the cleaning of the atomizer, a cleaning solvent which is introduced into the apparatus passes partially through the paint nozzle to the front surface of the cup and partially through the hub and solvent channels such that solvent passing through all of the aforesaid solvent, manifold and discharge channels is directed to and into the annular gap and impinges directly upon the motor shaft in a flow direction generally upstream to the main axial direction of flow through the cup, and the solvent then passes through the gap to the outer rear surface of the bell cup, whereby both the inner surface and the outer surface of the bell cup and the motor shaft are all cleaned by a rinsing action upon injection of solvent into the apparatus.

The number of solvent channels must be sufficient to effectively clean the apparatus, and eight (8) solvent channels formed therein is usually sufficient and is preferred, although more or less solvent channels may be adequate for specific applications.

In similar manner, the apparatus having thirty (30) discharge channels therein is also preferred, but more or less can be adequate and efficient in specific instances.

In a preferred embodiment, the bell cup is hollow between a front wall having a conically diverging front surface and a rearward wall having an outer rear surface. The cup may be constructed of a separate front wall component and a rear wall component, wherein the wall components of the cup and the hub are all affixed together by welding.

The front wall of the cup may be formed as a front cover extending from an outward location proximate the outer spray edge of the cup to an inward location proximate the hub, the cover being secured thereto by welds at both locations.

The apparatus may be used in applying paint to a workpiece substrate, and, when needed or desirable, in supplying a solvent cleaning agent to and through the atomizer, wherein both front and rear surfaces of the cup and the outer surface of the motor shaft are simultaneously cleaned.

Another embodiment of the invention includes rotary bell cup atomizing apparatus which includes a rotary bell cup atomizer as described above and wherein the apparatus includes a flow diverter positioned inside the cup proximate the nozzle. Paint supplied through the nozzle then impinges onto the diverter and is diverted radially outwardly therefrom. The apparatus according to the invention includes a tapered, replaceable sleeve insert placed in axial symmetry with the cup immediately adjacent the front surface thereof. The distal face of the insert is positioned so as to be in the direct outward radial flow path of outflowing paint, whereby this insert absorbs the force of impact of impinging paint thereon.

The cup and sleeve insert are preferably configured such that, upon insertion of the insert, the angle of the front surface of the insert substantially mimics the angle of taper of the front surface of the cup, whereby the insert provides substantially uninterrupted paint flow over both cup and insert.

The insert is constructed of a material having a hardness exceeding the hardness of the bell cup. The sleeve insert is preferably constructed of stainless steel, but other materials such as thermoplastics, thermosets, ceramics, and other metals may be suitable for specific applications. The insert, generally, is a material having a hardness value exceeding 30 HRC, and preferably exceeding 60 HRC.

In another preferred embodiment, the cup has at least one balancing indentation formed therein in the front surface of the cup immediately adjacent to the insert. The indents are placed, generally, circumferentially about the axis of rotation of the apparatus, where required to ensure rotational balance of the cup in operation. The cup can have a plurality of balancing indentations formed therein.

DETAILED DESCRIPTION OF THE INVENTION AND PREFERRED EMBODIMENTS WITH REFERENCE TO THE DRAWINGS

Rotary bell cup atomizing apparatus is provided. The bell cup atomizer has a rotatable bell cup component driven by a motor shaft, the assembly being dimensioned so as to provide an annular gap between the outer, rear surface of the cup and the motor shaft, the gap extending an effective and substantial distance axially adjacent the shaft. Solvent channels extend within the cup assembly so as to circumvent the annular gap and discharge into the gap proximate the distal end thereof. During cleaning of the atomizer, solvent introduced into the apparatus passes partially through the paint nozzle to the front surface of the cup and partially through the solvent channels, discharging into the annular gap and impinging directly upon the motor shaft, thence migrating over the outer surface of the cup. Both the inner surface and the outer surface of the bell cup and the motor shaft are simultaneously cleaned. The apparatus can include a replaceable sleeve placed inside the cup immediately adjacent the front surface thereof, in the direct outward radial flow path of outflowing paint, thereby absorbing the force of paint impinging thereon. The sleeve has a hardness exceeding the hardness of the bell cup. The cup may have at least one balancing indentation formed therein immediately adjacent to the sleeve to ensure balance of the apparatus.

Figure 1:
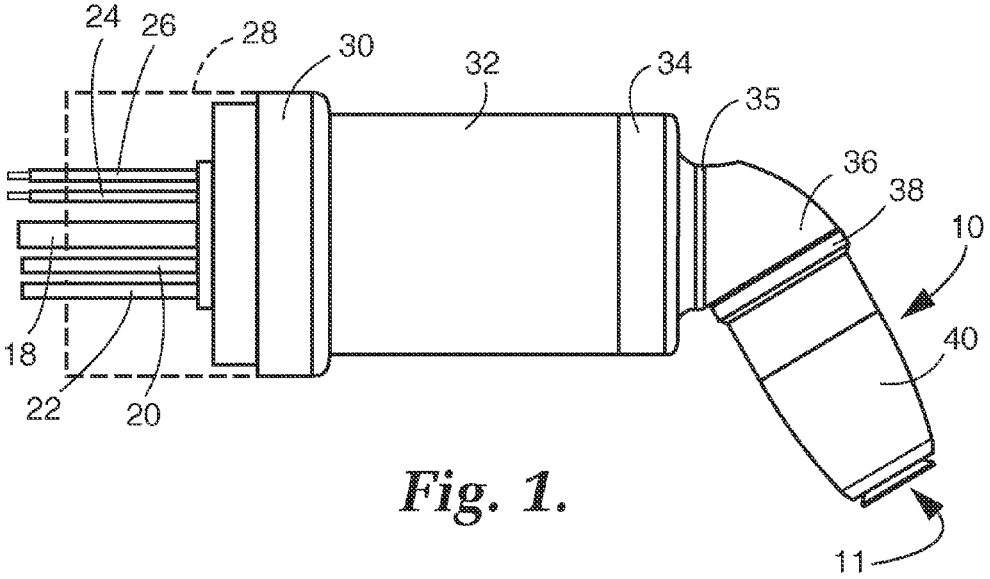
FIG. 1 is a side elevation, partially shown in phantom, of the rotary bell cup atomizing apparatus of the invention.

A detailed description of the invention and preferred embodiments is best provided with reference to the accompanying drawings, wherein FIG. 1 shows, in side elevation, the rotary bell cup atomizing apparatus, 10, of the invention, including the bell cup assembly 11 and its housing 40. The apparatus is shown mounted on robot arm 28, depicted in phantom, although other devices, including hand-held, may be used in specific applications. Supply lines extend through the arm 28 as shown, the lines including a paint supply line 18, electrical power line 24 and ground 26, the solvent supply line 20, and an air supply line 22 providing for shaping air shrouding the atomized paint during operation. Upstream housing 32 connects the bell cup apparatus 10 to the robot arm 28 by connecting joint 30, connectors 34, 35, and receiver 36 to which the cup housing 40 is affixed by cup connector 38, all as shown.

Figure 2:
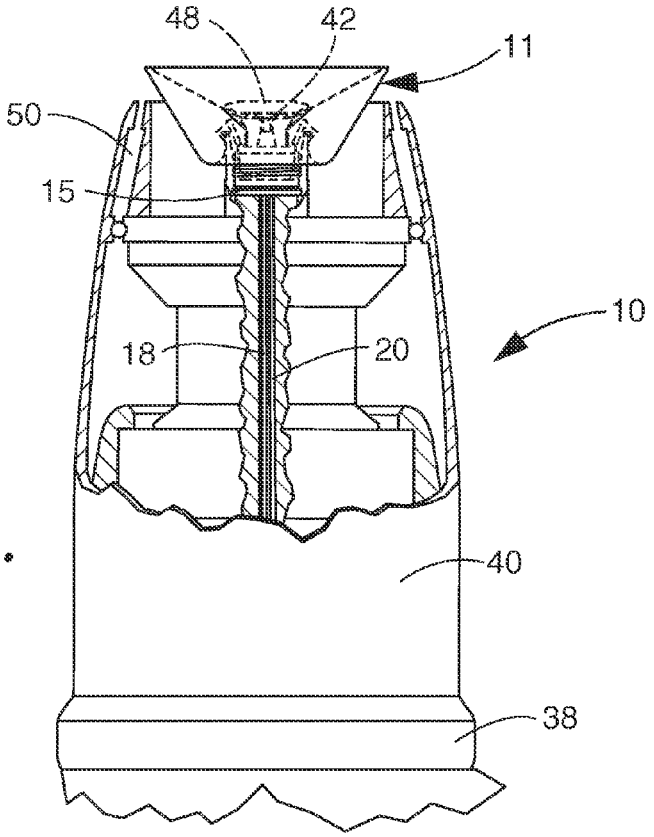
FIG. 2 is a side elevational view, partially broken away and in cross-section, of the bell cup and its housing as depicted in FIG. 1.

FIG. 2 shows, in side elevation, the bell cup atomizer 10 wherein, in a partially broken away view, the bell cup assembly 11 includes, within its housing 40, the paint and solvent supply nozzle 42, which is supplied with material through supply lines 18 (paint) and 20 (solvent) extending therethrough. Material supplied through nozzle 42 exits therefrom and impinges directly upon the flow diverter 48 positioned, as shown, in the direct path of material flow, all of which being described in more detail below. In operation, the bell cup assembly 11 is rotated rapidly, at typically 60-70,000 rpm, by a motor (not shown) driving motor shaft 15 to which the cup assembly 11 is affixed. The central supply nozzle 42 and supply lines 18, 20 therethrough remain stationary. Also depicted in FIG. 2 are air channels 50 through which shaping air is supplied during operation.

Figure 3:
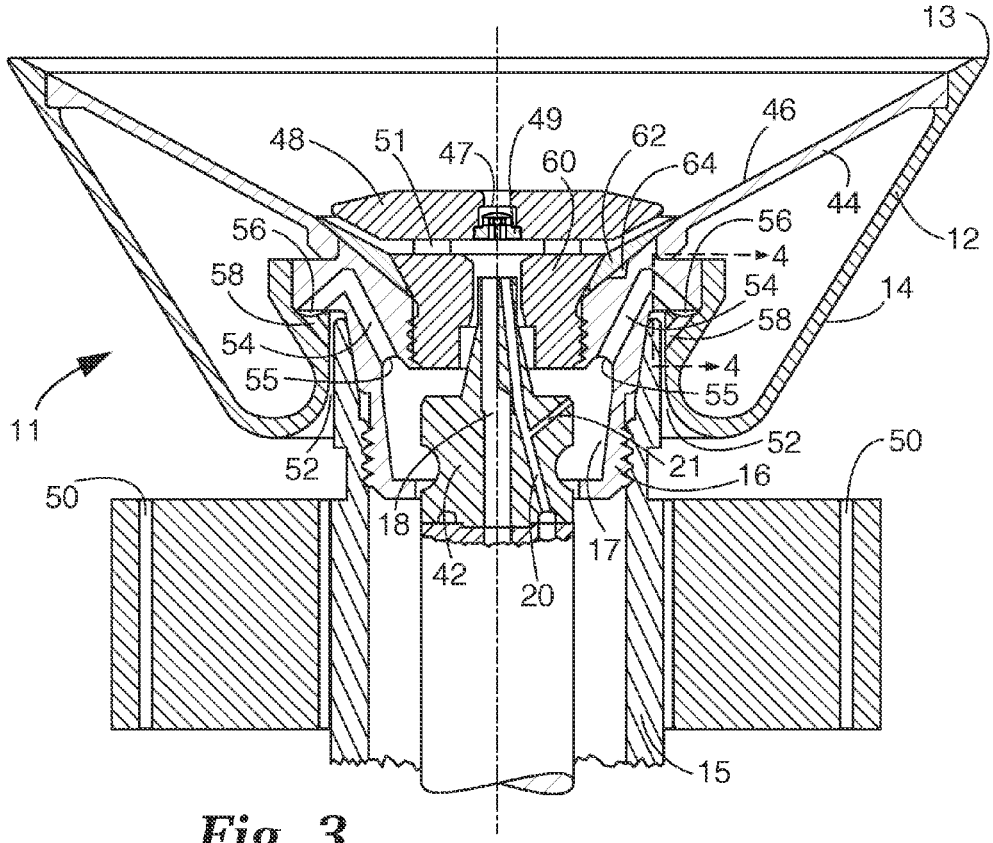
FIG. 3 is a cross-sectional view of the bell cup atomizer and the material supply nozzle according to a preferred embodiment of the invention.

FIG. 3 shows the bell cup assembly 11 of the invention in cross-section wherein the bell cup is preferably comprised of three components including the outer, rear component 12, as shown, an axially symmetric body or hub 16, and a front cover 44, all of component 12, hub 16 and cover 44 being affixed together, preferably by welding, and preferably constructed of titanium, although other materials know to those skilled in this art may be suitable for specific applications.

The hollow cup construction just described and as depicted in FIG. 3 is preferred but other, specifically solid, cup constructions could conceivably be employed, all within the scope of the invention.

The hub, or body, 16 of the cup assembly is hollow, having hollow 17 formed therein as shown, described in detail below, the hub 16 and affixed cup components 12, 44, being attachable, e.g. threadingly as shown in FIG. 3, to the distal end of motor shaft 15. Extending into the hub 16 at its proximal end is the stationary material supply nozzle 42, having paint supply channel 18 and solvent supply channel 20 extending therethrough as shown.

Also shown in FIG. 3 are the bell cup connecting insert 60, which is attachable to the cup hub 16 at its distal end, and to which the flow diverter 48 is attached by supports or connectors 51. The insert and diverter are constructed, preferably, of polyacetal and the connectors of stainless steel, respectively, all know in the art. To extend the useful life of the diverter 48, upon which coating material continually and forcefully impinges during operation, an impact absorbing button, 49, preferably of a metal such as stainless steel, is mounted as depicted in the figure.

Referring to FIG. 3, paint injected from nozzle 42 impinges onto diverter 48, 49 and is deflected radially outwardly therefrom, striking the inner, distal, outer, angled conical surface of the cup assembly 11, before flowing outwardly to the outer cup edge 13 where it is atomized. In prior cup constructions, the paint strikes this angular surface with such velocity that, over time, the cup material is worn away in this area. Such wear can result in unacceptable degradation of paint quality on the finished workpiece and, ultimately, premature bell cup replacement, both expensive to remedy. In accord with the invention herein, a hardened, replaceable wear sleeve 62, is inserted into the cup as shown in FIG. 3. The sleeve material is of a material having a hardness exceeding the hardness of a typical cup, and the hardness of sleeve 62 according to the invention exceeds 30 HRC. Preferably the sleeve hardness falls in the range of 30-60 HRC. As indicated above, stainless steel is a preferred material for this sleeve, but other materials may be used for specific applications.

As depicted in FIG. 3, sleeve 62 is constructed by dimensioning it to fit snugly and axially centrally within the cup and such that its distal surface, over which paint flows, presents substantially uninterrupted flow streamlines over the sleeve 62 and onto the outer distal surface 46 of adjacent cup cover 44.

Also shown in FIG. 3 is one (of possibly several) indents or balance points 64 which are formed in the body 16 of the cup assembly 11. Precise balancing of the cup assembly is required to ensure that each bell cup spins in a smooth, vibration free manner throughout the painting process. To achieve this balance, small amounts of material are removed at precise locations as defined by balancing equipment. It is known that prior art cups, such as those described in U.S. Pat. No. 5,707,009, have included one or more indents created in the cup. Small amounts of material are removed, for example, from the interior proximal surface of the cup body, that is, from the upper interior surface of the annular cavity. During the painting process, this surface can be subjected to paint overspray that can migrate into these balancing indents. In these prior cups, although this annular space, such as 15 in the '009 patent, is washed following the painting process, these indents are deep enough to prevent the rinsing agent from cleaning them completely, thus leaving behind trapped paint, only to be expelled during a subsequent painting process, thus fouling the painted surface. As shown in FIG. 3, balancing indents according to the invention herein are placed in the front distal surface of the cup body 16, positioned under the protective wear sleeve 62. This construction prevents paint residue from finding any open cavities, thereby eliminating this fouling issue completely.

Among the keys to the invention herein are the flow channels 54, 56, 58, and the annular gap 52 between the rear outer, proximal surface of the cup component 12 and the motor shaft 15, as shown in FIG. 3. In prior cup assemblies, such as in U.S. Pat. No. 5,707,009, as depicted therein, in a cleaning cycle, the rinsing agent is directed through centrifugal force from the interior to the outer cup surface and is then distributed uniformly across the perimeter. The rinsing agent can branch off centrally and move to a collection space (29, 15 in the reference) located radially within the outer surface, from where it flows via the rear, rounded bell dome edge. The "collection space" 15, otherwise described as a reservoir, opens axially to the rear and has a "U"-shaped cross-section which adjoins the edge in the rear of the bell element. Rinsing channels disposed at angular intervals around the central axis are used, wherein a rinsing agent flows through the rinsing channels and into the annular collection space 15, and finally over the rear edge of the cup, all as shown in FIG. 1 of the reference.

In contrast to prior art bell cup atomizing apparatus, FIG. 3 herein depicts the channeling in the cup assembly of the present invention which is specially adapted to efficiently clean all operative surfaces of the bell cup and the motor shaft to which the cup is attached and which drives the cup.

In the cup assembly 11, the mated cup component 12 and the hub 16 receive the distal end of the motor shaft 15 as shown, with the hub 16, shaft 15, and cup component 12 being dimensioned so as to provide a relatively narrow gap 52 between the outer, rear surface 14 of the cup 12 and the shaft 15, the gap 52 extending an effective and substantial distance axially adjacent to the motor shaft 15, all as shown.

As can be seen from FIG. 3, following a painting cycle, a rinsing solvent which is injected into the system via solvent supply line 20 flows forwardly to and over the distal front surface 46 of cup assembly 11. Simultaneously and concurrently, a portion of the solvent flows through branched solvent supply line 21, exiting into the hollow 17 in the cup body 16. As shown, a plurality of solvent channels 54 formed in the cup extend through the cup body 16 from entrance openings 55 from hollow 17, the channels 54 extending through the hub and cup so as to circumvent the annular gap 52, extending over and around the gap 52, exiting into manifold channel 56 which extends circumferentially about the axis of rotation of the cup, thereby fluidly interconnecting all solvent channels 54 and the manifold channel 56, as depicted in the figure. From manifold channel 56, a plurality of solvent discharge channels 58, formed as shown, extend generally rearwardly from the manifold channel 56 to the gap 52, exiting therein proximate the distal end of annular gap 52. Solvent injected as described above flows into and through solvent channels 54, into the manifold channel 56 and through discharge channels 58, all being fluidly connected, and discharges into the gap 52 such that it impinges directly toward and onto the motor shaft 15, all as shown. The solvent so injected thereby rinses and cleans all operative surfaces 46, 13 and 14 of the cup, as well as the motor shaft 15.

While the specific numbers of solvent channels 54 and discharge channels 58 may differ for different operations to be effective at cleaning all paint residue from all operative surfaces, it has been found that eight (8) solvent channels 54 and thirty (30) discharge channels 58 are effective for a typical painting operation, and those numbers of the pluralities of the respective channels are preferred.

Figure 4:
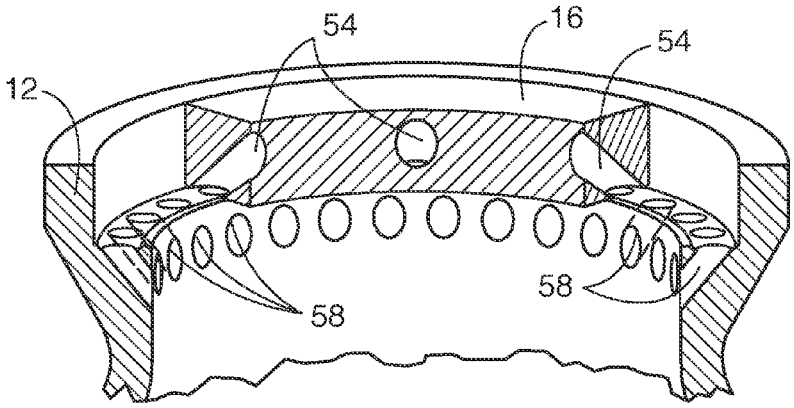
FIG. 4 is a cross-sectional schematic view of the apparatus of the invention taken along line 4-4 of FIG. 3.

FIG. 4, a schematic cross-section taken along line 4-4 of FIG. 3, shows cup component 12 in which the plurality of discharge channels 58 are depicted relative to the solvent channels 54 formed in the hub 16, all such channels being fluidly interconnected by the manifold channel 56, not visible in the figure.

Figure 5:
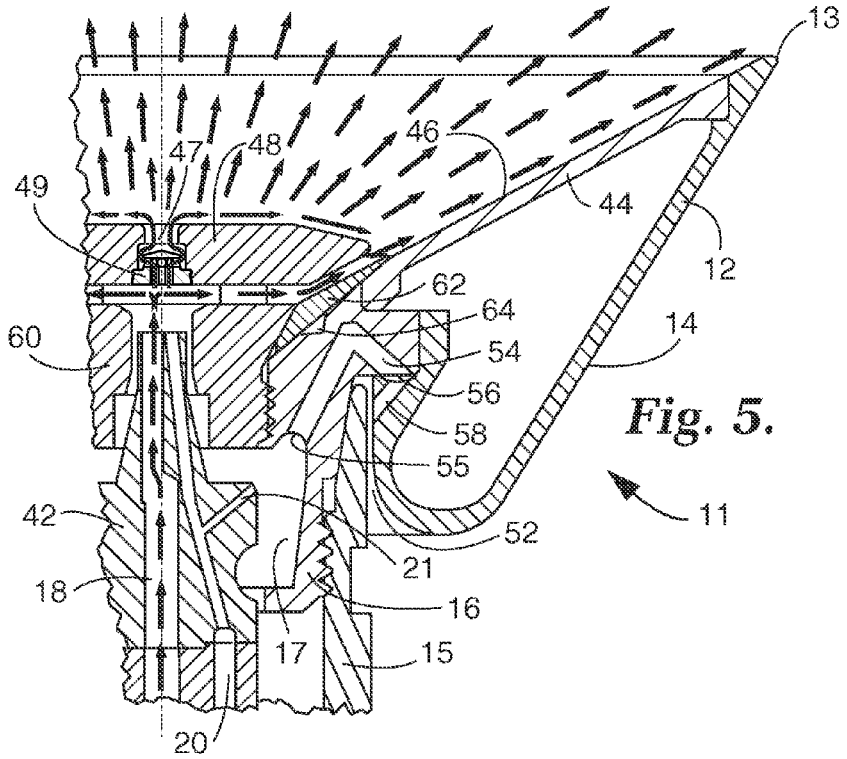
FIG. 5 is a partial cross-sectional view of the bell cup atomizer depicted in FIG. 3 and showing, schematically, the flow of paint therethrough during a painting operation.
Figure 6:
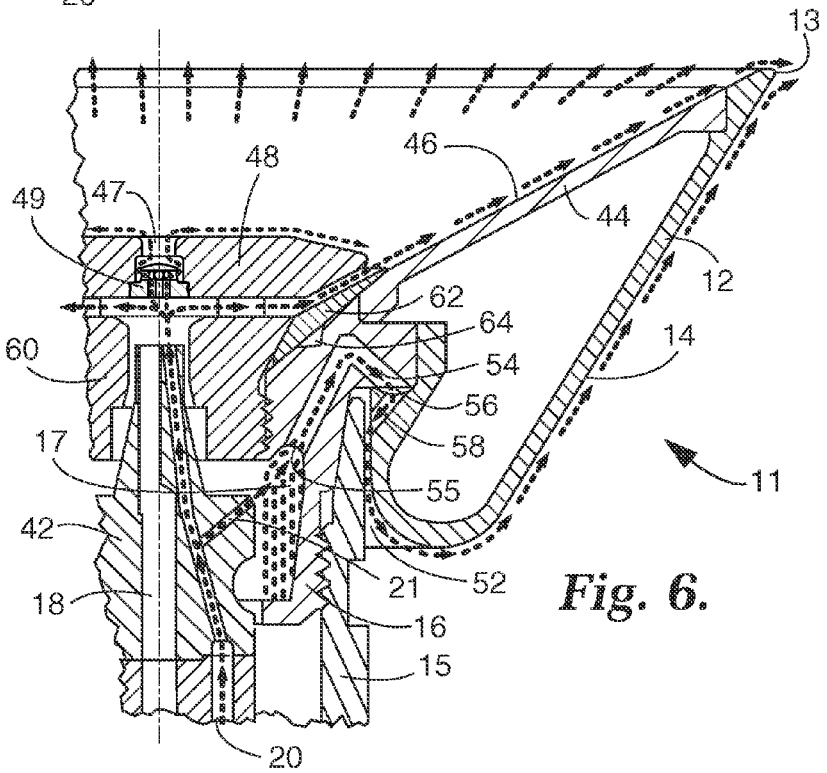
FIG. 6 is a partial cross-sectional view of the bell cup atomizer depicted in FIG. 3 and showing, schematically, the flow of cleaning solvent therethrough during a cleaning/rinsing cycle.

FIG. 5 depicts the flow patterns of paint flowing through the bell cup apparatus during a painting cycle, and FIG. 6 depicts the flow patterns of cleaning solvent flowing through the bell cup apparatus during a cleaning cycle, wherein common components are all designated by the same numerals as used in FIG. 3.

Referring to FIG. 5, paint injected through supply line 18 and forced under pressure to and through the nozzle 42 impinges directly onto the impact button 49, having small apertures therethrough, which is embedded in the flow diverter 48, and is diverted radially outwardly therefrom, as represented by the many solid arrows shown in the figure. A small portion of the paint flows, as shown and as known in the art, through the passage 47 to the front surface of the diverter 48, and all paint flows to the outer edge 13 of the cup assembly 11 where it is atomized and applied to a workpiece (not shown) by the centrifugal forces of the spinning cup.

When apparatus cleaning is required, or desired, between painting cycles, cleaning solvent such as acetone is injected into the apparatus as shown in FIG. 6, depicted by the many dashed arrows shown. The solvent enters under pressure through supply line 20, from there proceeding partially forwardly through nozzle 42 impacting the diverter and button 48, 49, and flowing partially through the branched solvent supply channel 21, which discharges into the hollow 17 in the cup body 16.

Solvent flowing radially outwardly from the diverter 48, 49 flows over the wear sleeve 62, over the front (distal) surface 46 of cover 44, and exits at the cup edge 13, all as indicated by the arrows, cleaning the cup distal surface 46 and edge 13 as it flows. As described above, a small portion of solvent also flows through the passageway 47 to the front surface of diverter 48 and then over surface 46 of cover 44.

The portion of cleaning solvent that flows from the branched supply line 21 into the hollow 17 passes first into the solvent channels 54, thereby circumventing the annular gap 52, and then flows into the circumferential manifold channel 56, following which it flows, as shown, through the discharge channels 58, to ultimately impinge directly onto the motor shaft 15 and then migrate around the outer proximal surface 14 of cup component 12, thereby effectively cleaning the shaft 15 and the outside surface 14 of the cup.

Figure 7:
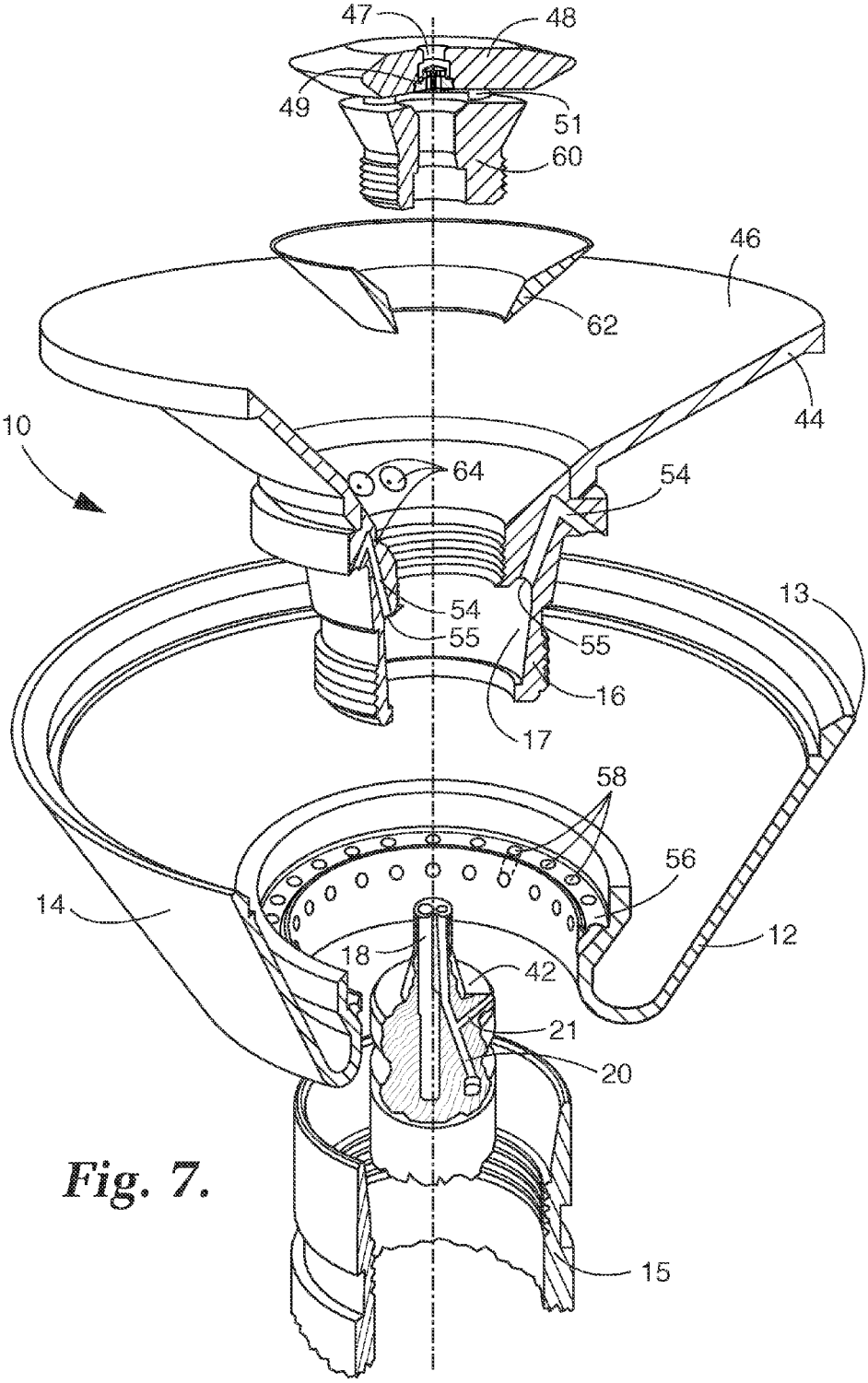
FIG. 7 is an exploded perspective view, partly in cross-section, showing the components of the rotary atomizing apparatus of the invention.

FIG. 7 is an exploded perspective view of the components of the rotary bell cup atomizing apparatus 10 of the invention. Proceeding from the motor shaft 15 on which the hollow bell cup assembly is mounted, the paint supply line 18 and solvent supply line 20 are shown passing through and housed within the stationary nozzle 42, the branched solvent supply line 21 also being visible in this view. The bell cup rear cover 12 with outer surface 14 and edge 13 is depicted as a separate component from the front cover 44 and hub 16, although these components are affixed in operation. Within the cup component 12 are shown the circumferential solvent manifold channel 56 and the plurality of solvent discharge channels 58 arranged in symmetrical orientation about the central axis of the apparatus. Mating with the cup component 12 is the hub/body 16 having the annular inner hollow space 17, the mating being effected threadingly as shown. Two of the plurality of solvent channels 54 formed in hub 16 are visible in FIG. 7.

In cover 44, three indents (or balance points) 64 are shown which are formed in the distal surface 46 of the cup cover 44 which, as described earlier herein, provides a structure not seen heretofore in rotary bell cup components for the reasons detailed hereinabove. While such indents 64 are known in the industry to balance the apparatus during rotation, such balance points have heretofore been placed in proximal locations, in rearward surfaces of the cup components, for obvious reasons, that is, in prior cups having no wear sleeve, if indents were placed in the front distal surface of the cup over which paint flows, those indents would form stagnant flow regions where undesirable "dirt" deposits would form. The present invention obviates that possibility.

In the assembly of FIG. 7, the wear sleeve 62 is fitted in axial symmetry adjacent the front surface 46 of the cup cover 44. The sleeve 46 and the cup cover 44 are dimensioned such that both fit precisely together to present a substantially smooth streamlined flow of fluid over their mated surfaces, as shown. That is, on assembly, the angle of the front surface of sleeve 62 from the horizontal substantially mimics the angle of the surface 46 of the front cover 44 from the horizontal.

To complete the assembly, the connecting insert 60, having the flow diverter 48 and impact button 49 secured thereto by supports 51, is affixed to hub 16, preferably threadingly as shown.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Rotary bell cup atomizing apparatus having improved, integral cleaning capability, the apparatus comprising:

a rotary bell cup atomizer having a rotatable bell cup component mounted at its proximal end to a rotatable motor shaft, the bell cup component having an inner front surface and an outer rear surface, said bell cup component having a conically diverging opening distally of the motor shaft and being connected thereto by means of a hollow hub affixed to or integral with said bell cup component, thereby mating said bell cup component and hub, the motor shaft being hollow and housing supply lines for different fluids, the supply lines being connected at their upstream ends to respective fluid supply reservoirs, each line extending into said hub to supply a desired fluid thereto on demand, the supply lines including at least one paint supply line for supplying paint to the inner front surface of said bell cup component via a nozzle, the paint to be atomized and applied to a substrate, and at least one solvent cleaning agent supply line for supplying solvent to said nozzle and into the hollow of said hub, said mated bell cup component and hub receiving said motor shaft at its distal end, the hub, shaft and bell cup component being dimensioned so as to provide an annular gap between the outer, rear surface of said bell cup component and said motor shaft, said gap having a proximal and a distal end and extending an effective distance axially, adjacent said shaft, wherein said mated bell cup component and hub include a plurality of solvent channels formed therein extending from entrance openings from said hollow of said hub and extending within said hub circumventing said gap, each of said channels then extending in a direction generally rearwardly to an intermediate opening into a manifold channel formed therein extending circumferentially about the axis of rotation of said bell cup component, said manifold channel interconnecting all said solvent channels, wherein said mated bell cup component and hub includes a plurality of solvent discharge channels extending generally rearwardly from said circumferential manifold channel, each discharge channel extending to an exit opening therefrom proximate said distal end of said annular gap, whereby a cleaning solvent which is introduced into said apparatus passes partially through said nozzle and partially into and through said hub and solvent channels, wherein solvent passing through said solvent channels is directed to and into said gap and impinges upon said motor shaft in a generally rearwardly flow direction, then passes through said gap and flows over the outer surface of said bell cup component, whereby both the inner surface and the outer surface of said bell cup component and said motor shaft are cleaned by a rinsing action on injection of said solvent.

2. The apparatus of claim 1 having eight (8) said solvent channels formed therein.

3. The apparatus of claim 1 having thirty (30) said discharge channels therein.

4. The apparatus of claim 1 wherein said bell cup component is hollow between a conically diverging front wall having said front surface and a rearward wall having said outer rear surface.

5. The apparatus of claim 1 wherein said bell cup component and hub are affixed by welding.

6. The apparatus of claim 4 wherein said front wall of said bell cup component is formed as a front cover extending from an outward location proximate an outer spray edge of said bell cup component to an inward location proximate said hub, the cover being secured thereto by welds at both locations.

7. A process of painting a workpiece substrate using the apparatus of claim 1 comprising the steps of supplying paint to said apparatus, and atomizing and applying said paint to said substrate.

8. The process of claim 7 further comprising supplying a solvent cleaning agent to said apparatus, whereby both said front and rear surfaces of said bell cup component and the outer surface of said motor shaft are simultaneously cleaned.

9. Rotary bell cup atomizing apparatus comprising a rotary bell cup atomizer having a rotatable bell cup component having an inner front surface and an outer rear surface mounted at its proximal end to a rotatable motor shaft, said bell cup component opening distally of the motor shaft and being connected thereto by means of a hollow hub, the motor shaft being hollow and housing supply lines for different fluids, the supply lines being connected at their upstream ends to respective fluid supply reservoirs, each line extending into said hub to supply a desired fluid thereto on demand, the supply lines including at least one paint supply line for supplying paint via a nozzle, the paint to be atomized and applied to a substrate, the apparatus including a flow diverter positioned inside said bell cup component proximate said nozzle, wherein paint supplied through said nozzle impinges onto said diverter and is diverted radially outwardly therefrom, the apparatus including a tapered, replaceable sleeve insert having a front distal surface and a rear proximal surface placed in axial symmetry with said bell cup component immediately adjacent said front surface of said bell cup component, wherein said distal surface of said insert is positioned in said outwardly diverted radial flow path of said paint, wherein said bell cup component has at least one balancing indentation therein in the front surface of said bell cup component immediately adjacent said sleeve insert, whereby said insert absorbs the force of impact of impinging paint thereon.

10. The apparatus of claim 9 wherein said bell cup component has a plurality of said balancing indentations therein.

11. The apparatus of claim 9 wherein said bell cup component and insert are configured such that, upon insertion of said insert, said front surface of said insert substantially mates with the front surface of said bell cup component, the insert thereby providing substantially uninterrupted paint flow over both said bell cup component and said insert.

12. The apparatus of claim 9 wherein said insert is constructed of a material having a hardness exceeding the hardness of said bell cup component.

13. The apparatus of claim 9 wherein said insert is constructed of stainless steel.

14. The apparatus of claim 9 wherein said insert is constructed of a material having a hardness value exceeding 30 HRC.

15. The apparatus of claim 14 wherein said insert is constructed of a material having a hardness value in the range of 30-60 HRC.

* * * * *